US011564482B2

(12) United States Patent
Zheng

(10) Patent No.: US 11,564,482 B2
(45) Date of Patent: Jan. 31, 2023

(54) SCREW ROD SELF-LOCKING DEVICE, AND HEIGHT-ADJUSTABLE LEG AND HEIGHT-ADJUSTABLE DESK APPLYING THE SAME

(71) Applicant: NINGBO INTECH SMART TECHNOLOGY CO., LTD, Ningbo (CN)

(72) Inventor: Bisheng Zheng, Ningbo (CN)

(73) Assignee: NINGBO INTECH SMART TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 17/403,906

(22) Filed: Aug. 17, 2021

(65) Prior Publication Data

US 2022/0312953 A1 Oct. 6, 2022

(30) Foreign Application Priority Data

Mar. 31, 2021 (CN) ..... 202110345520.6

(51) Int. Cl.
*A47B 9/04* (2006.01)

(52) U.S. Cl.
CPC ..... *A47B 9/04* (2013.01); *A47B 2200/0052* (2013.01)

(58) Field of Classification Search
CPC ..... A47B 9/04; A47B 2200/0052
See application file for complete search history.

(56) References Cited

U.S. PATENT DOCUMENTS

| | | | | |
|---|---|---|---|---|
| 10,524,564 | B1 * | 1/2020 | Wu | A47B 9/20 |
| 2009/0121100 | A1 * | 5/2009 | Waidelich | A47B 9/04 248/188.4 |
| 2018/0172062 | A1 * | 6/2018 | Hu | H02K 7/06 |
| 2019/0357668 | A1 * | 11/2019 | Knudtson | A47B 9/04 |
| 2020/0085184 | A1 * | 3/2020 | Lu | A47B 9/04 |
| 2020/0121081 | A1 * | 4/2020 | Yin | A47B 9/04 |
| 2021/0321760 | A1 * | 10/2021 | Windhaber | F16H 25/2056 |

* cited by examiner

*Primary Examiner* — Daniel J Rohrhoff
(74) *Attorney, Agent, or Firm* — Bayramoglu Law Offices LLC

(57) ABSTRACT

A screw rod self-locking device includes a one-way bearing and a mounting seat, and an inner hole of the one-way bearing is sleeved at an end of a screw rod. A mounting hole for receiving the one-way bearing is disposed on the mounting seat, and the one-way bearing is rotatably fitted into the mounting hole along a circumferential direction. An adjusting mechanism for adjusting a circumferential locking force of the mounting hole for the one-way bearing is disposed on the mounting seat so as to adjust a size of a friction force between an outer wall of the one-way bearing and an inner wall of the mounting hole. A height-adjustable leg and a height-adjustable desk applying the same are further provided. In this way, a size of a self-locking friction force to be overcome during backward rotation of a screw rod can be self-defined, thereby guaranteeing consistency of product performances.

18 Claims, 8 Drawing Sheets

SCREW ROD SELF-LOCKING DEVICE, AND HEIGHT-ADJUSTABLE LEG AND HEIGHT-ADJUSTABLE DESK APPLYING THE SAME

CROSS REFERENCE TO THE RELATED APPLICATIONS

This application is based upon and claims priority to Chinese Patent Application No. 202110345520.6, filed on Mar. 31, 2021, the entire contents of which are incorporated herein by reference.

TECHNICAL FIELD

The present invention relates to the field of height-adjustable platform technologies, and in particular to a screw rod self-locking device, and a height-adjustable leg and a height-adjustable desk applying the same.

BACKGROUND

In the prior art, computer desks always have a fixed height. However, different users or different use conditions may require the desktops of the computer desks to be at different heights for ease of use. For example, due to body heights of users and heights of computer chairs, the users will have different requirements for the heights of the desktops of the computer desks. In order to better satisfy the requirements of the users, a height-adjustable desk comes into being gradually. At present, in the field of the height-adjustable desks, a linear actuator is widely applied. Such linear actuator generally comprises a drive motor, a rotary screw rod, and a transmission nut, where the drive motor rotates the rotary screw rod which then drives the transmission nut connected to a driven object to perform axial movement, thereby realizing the purpose of driving desk legs to ascend or descend.

A self-locking function is required in such a structure in which the legs are driven to extend or retract through the linear actuator. That is, when a motor is in a motionless state, a lifting column should have the self-locking function to realize self-locking of the rotary screw rod, thus preventing the height-adjustable desk from descending automatically. At present, the self-locking functions of such lifting columns on market mostly are realized by relying on a braking torsional spring. Specifically, when the rotary screw rod rotates backward, the braking torsional spring is driven to lock up to produce a braking force. However, at present, such self-locking structures have insufficient self-locking force.

Along with technical progress, some devices which utilize the characteristics of one-way bearing to realize self-locking gradually come up. In spite of improvement of the self-locking force in the existing self-locking devices with one-way bearing, a friction force between an outer sidewall of the bearing and an inner sidewall of a bearing seat is un-adjustable after the one-way bearing and the bearing seat are mounted. In this case, the friction force between the one-way bearing and the bearing seat cannot be adjusted according to the requirements of the users. On the other hand, in an actual processing procedure, due to unequal tolerances of parts, the reversing friction forces of the one-way bearings in the bearing seats are different after assembly, resulting in a low consistency.

SUMMARY

In order to overcome the defects of the prior art, the present invention provides a screw rod self-locking device and a height-adjustable leg and height-adjustable desk applying the same, in which a size of a self-locking friction force to be overcome during backward rotation of a screw rod can be self-defined, thereby guaranteeing consistency of product performances.

The technical solution employed by the present invention is described below: provided is a screw rod self-locking device, comprising a one-way bearing and a mounting seat, where an inner hole of the one-way bearing is sleeved at an end of a screw rod, a mounting hole for receiving the one-way bearing is disposed on the mounting seat, the one-way bearing is rotatably fitted into the mounting hole along a circumferential direction, and an adjusting mechanism for adjusting a circumferential locking force of the mounting hole for the one-way bearing is disposed on the mounting seat so as to adjust a size of a friction force between an outer wall of the one-way bearing and an inner wall of the mounting hole.

Compared with the prior art, the present invention has the following advantages.

The novel structure divides the mounting seat into two mounting blocks, the one-way bearing is locked up and limited between arc-shaped fitting grooves of the two mounting blocks which have an adjustable locking force for the one-way bearing, thus realizing adjustment to the friction resistance between the one-way bearing and the inner wall of the mounting hole. In this structure, when the screw rod rotates forward, an outer ring of the one-way bearing and the inner wall of the mounting hole are relatively stationary with only the screw rod rotating in the inner hole of the one-way bearing; when the screw rod rotates backward, the screw rod cannot rotate in the inner hole of the one-way bearing due to the characteristic of one-way rotation of the one-way bearing, and at this time, the rotating screw rod drives the one-way bearing to rotate in the mounting hole simultaneously. Correspondingly, in a backward rotation process, a driving force of a driving mechanism needs to firstly overcome the friction resistance between the outer wall of the one-way bearing and the inner wall of the mounting hole and then drive the one-way bearing and the screw rod to rotate synchronously. Due to uncertainty of the friction resistance between the outer wall of the one-way bearing and the inner wall of the mounting hole, it is also a challenge for a driving power of the driving mechanism. After the self-locking device of the present invention is adopted, the reverse driving friction force of each product may be adjusted according to requirements of customers before leaving factory, so as to ensure consistency of product performances. That is, the friction resistances to be overcome during backward rotation are kept consistent and the requirements for the driving forces of the driving mechanisms are also consistent.

Further, the mounting seat comprises two split-type mounting blocks, an arc-shaped fitting groove is disposed on each mounting block, and the two mounting blocks are connected together through bolts along opposite directions such that the two arc-shaped fitting grooves are combined to form the mounting hole; when the one-way bearing is fitted into the mounting hole, a first adjustment gap D1 is disposed between mating end faces of the two mounting blocks and a size of the first adjustment gap D1 may be adjusted by rotating the bolts to realize adjustment to the friction force between the outer wall of the one-way bearing and the inner wall of the mounting hole.

As an improvement, a locating insertion hole and a locating insertion column are respectively disposed at two ends of the two mounting blocks close to the one-way bearing, and the locating insertion hole and the locating insertion column on the two mounting blocks are staggered in position. With the improved structure, better guiding and limitation effect can be achieved when the two mounting blocks are mounted along opposite directions, thus ensuring the position accuracy of the two connected mounting blocks.

As a further improvement, a lubrication groove for filling lubricant is disposed at the inner sidewall of the mounting hole and/or the outer sidewall of the one-way bearing. The disposal of the lubrication groove helps to fill lubricant between the one-way bearing and the mounting hole, so as to improve lubrication effect for the running environment of the one-way bearing, reduce generation of frictional heat, and extend the service life.

As a further improvement, the lubrication groove comprises a plurality of helical grooves disposed at the inner sidewall of the arc-shaped fitting grooves and extending axially, and the plurality of helical grooves are distributed in the form of grid. In this structure, the lubrication groove is disposed into a plurality of helical grooves distributed in the form of grid, such that the entire channel between the outer wall of the one-way bearing 1 and the inner wall of the mounting hole can be uniformly filled with lubricant. Thus, the lubrication effect during the rotation of the one-way bearing 1 in the mounting hole can be effectively improved, reducing the frictional heat and prolonging the service life. Further, no abnormal sound is generated.

As a further improvement, when the one-way bearing is fitted into the mounting hole, a second adjustment gap D2 is disposed between two widthwise sides of the arc-shaped fitting grooves and the outer sidewall of the one-way bearing. In this case, when the gap between two mounting blocks is adjusted by tightening bolts, the two sides of the arc-shaped fitting groove of each mounting block will be attached closer to the sidewall of the one-way bearing to increase a contact area between the inner sidewall of the mounting hole and the outer sidewall of the one-way bearing, thus increasing the friction force between the outer wall of the one-way bearing 1 and the inner wall of the mounting hole. When it is required to reduce the friction resistance between the outer wall of the one-way bearing and the inner wall of the mounting hole, the bolts may be fine-tuned reversely.

As a further improvement, a limiting baffle plate is disposed at both axial ends of the arc-shaped fitting groove of the mounting block respectively, a notch is disposed at a position of the limiting baffle plate corresponding to a middle portion of the arc-shaped fitting groove, and the notch extends radially to the bottom of the arc-shaped fitting groove. In this structure, the limiting baffle plate is mainly used to achieve axial limitation for the one-way bearing in the mounting seat, and the notch is mainly used to achieve better bending deformation of both ends of the mounting block under the tightening action of the bolts, so as to ensure adjustment to the locking force of the mounting hole for the one-way bearing.

As a further improvement, an arc-shaped locating groove is further disposed at a position of the limiting baffle plate close to the center of the one-way bearing to form a locating plate mated with a locating recessed groove pre-disposed on the screw rod. With this improved structure, the screw rod and the self-locking device can be more easily mounted, that is, the two mounting blocks can be directly fitted together along opposite directions. Furthermore, the axial limitation of the screw rod and the mounting blocks is more convenient, stable and reliable.

Correspondingly, the present invention further provides a height-adjustable leg comprising an inner tube and an outer tube. The outer tube is slidably sleeved on the inner tube, the screw rod is inserted through the inner tube, a screw rod sliding block is sleeved on the screw rod, the screw rod sliding block is fixedly connected with the inner tube, and an end of the screw rod is connected with a driving mechanism. The present invention further comprises the screw rod self-locking device according to any item of the above solution. The self-locking device is connected with an end of the screw rod away from the driving mechanism, and an elastic limiting portion for limiting the self-locking device to a sidewall of the inner tube is disposed at an outer sidewall of the self-locking device.

Preferably, the elastic limiting portion comprises at least two elastic limiting plates symmetrically disposed on sidewalls of the mounting block. The elastic limiting plate is abutted against the sidewall of the inner tube in a limited manner. One end of the elastic limiting plate extends along an axial direction of the inner tube and is capable of deforming elastically along an radial direction of the inner tube. With this structure, the self-locking device can be more easily and stably mounted and located in the inner tube.

Furthermore, the present invention further provides a height-adjustable desk, comprising a load-bearing board. Two desk legs are disposed at a lower end of the load-bearing board, and at least one of the two desk legs is the above height-adjustable leg. When the height-adjustable desk of this structure is adjusted in height, the screw rod in the height-adjustable leg can realize self-locking and the reverse driving friction force of the screw rod is adjustable.

BRIEF DESCRIPTIONS OF THE DRAWINGS

Figure 1:
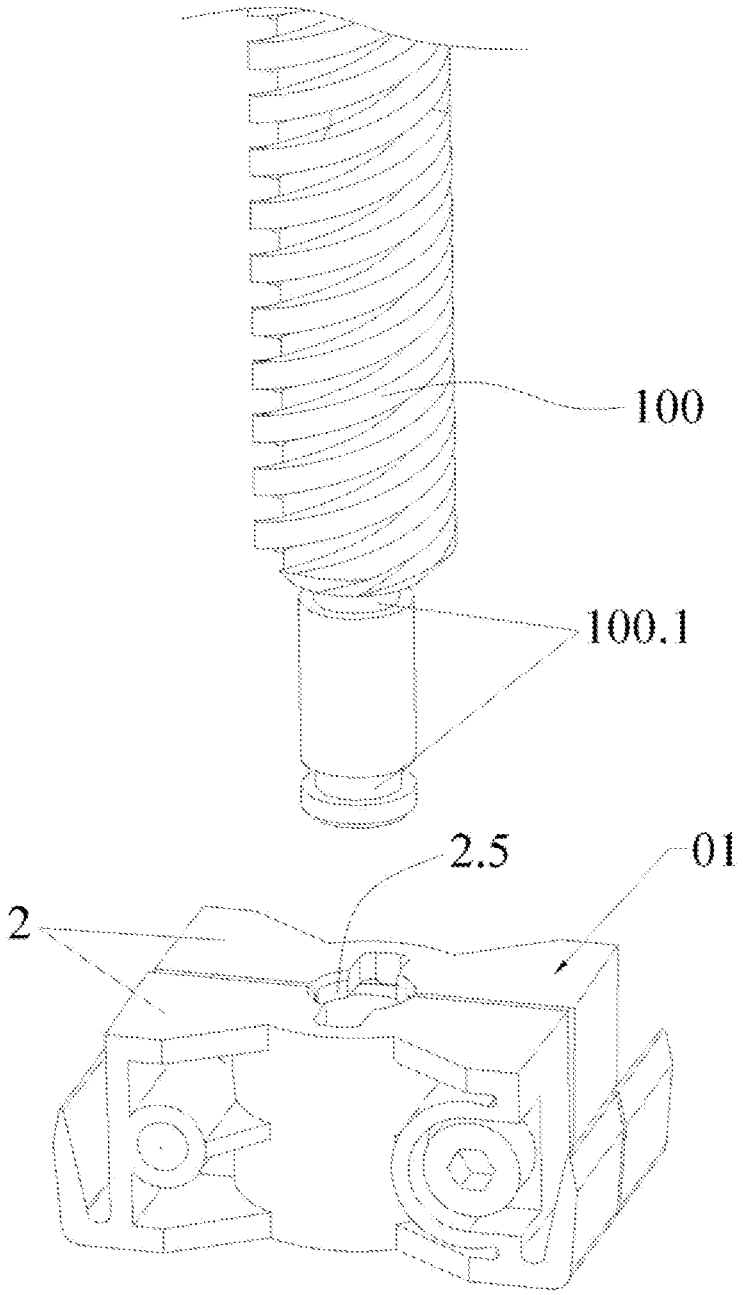
FIG. 1 is a structural schematic diagram of a screw rod self-locking device according to the present invention.

In the drawings, the reference numerals are described below: 01—mounting seat, 1—one-way bearing, 2—mounting block, 2.1—arc-shaped fitting groove, 2.2—locating insertion hole, 2.3—locating insertion column, 2.4—helical groove, 2.5—limiting baffle plate, 2.5.1—notch, 2.5.2—arc-shaped locating groove, 3—bolt, 4—elastic limiting plate, 100—screw rod, 110—inner tube, 120—outer tube, 130—screw rod sliding block, 200—load-bearing board, 210—desk leg, 220—support rod.

DETAILED DESCRIPTIONS OF THE EMBODIMENTS

The present invention will be further described below in combination with the accompanying drawings and specific embodiments.

In the descriptions of the present invention, it is understood that orientation or positional relationship indicated by the terms such as "outer wall", "inner wall", "middle portion", "up and down", and the like is based on the orientation or positional relationship shown in the accompanying drawings and used only for ease of descriptions and simplification of descriptions and does not indicate or imply that the indicated devices or elements must have a particular orientation, or be constructed or operated in a particular orientation. Therefore, such terms shall not be understood as limiting of the present invention. Furthermore, the terms such as "first", "second", are used for the purpose of descriptions only rather than understood as indicating or implying relative importance.

In the descriptions of the present invention, unless otherwise clearly stated or defined, the term "connect" shall be understood in a broad sense, for example, may be fixed connection, or detachable connection, or formed into one piece; or may be mechanical connection, or electrical connection; or direct connection or indirect connection through an intermediate medium, or may be internal communication between two elements. Those skilled in the art may understand the specific meanings of the above terms in the present invention according to actual situations.

Figure 2:
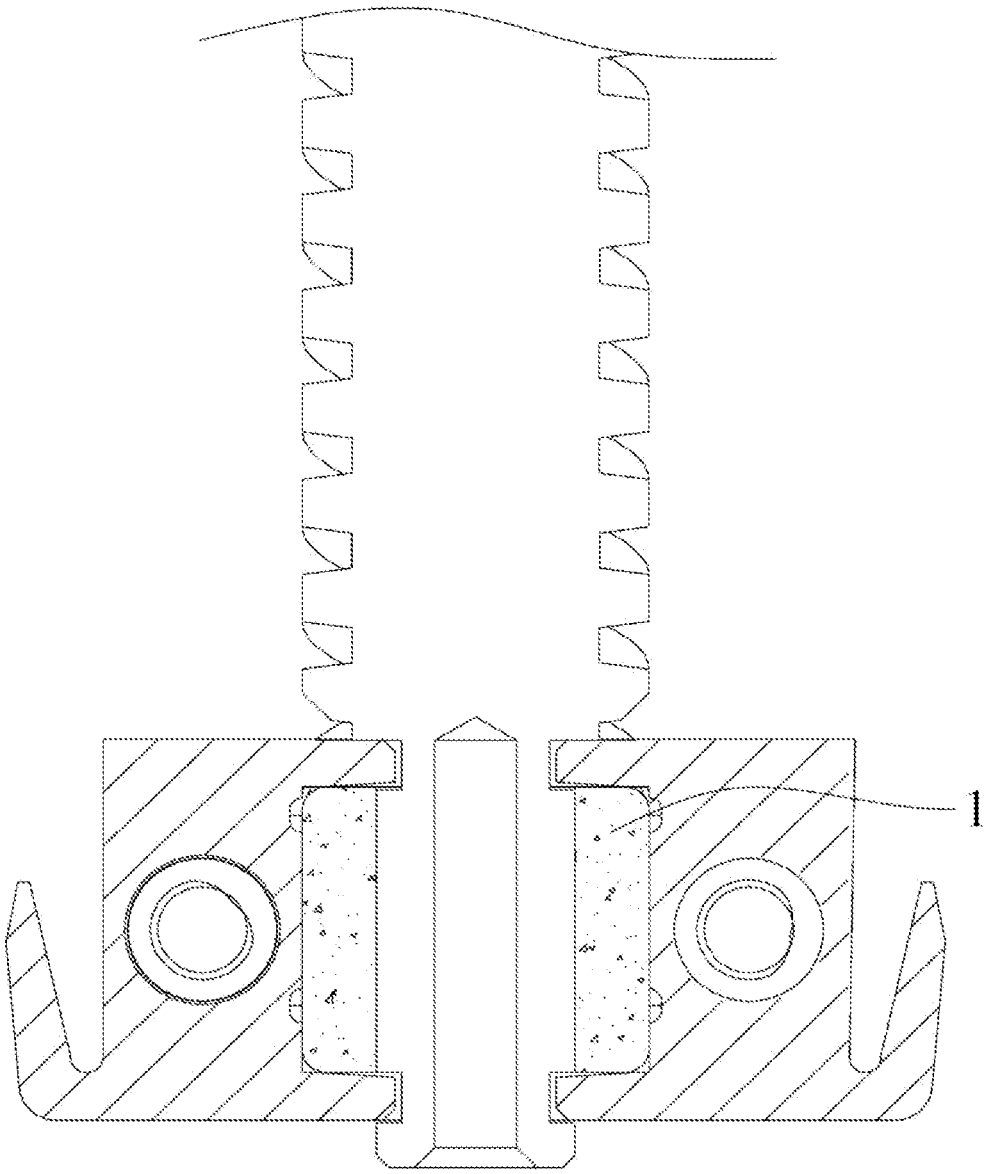
FIG. 2 is a sectional view of a screw rod self-locking device according to the present invention.

As shown in FIGS. 1 and 2, the present invention provides a screw rod self-locking device comprising a one-way bearing 1 and a mounting seat 01. An inner hole of the one-way bearing 1 is sleeved on an end of a screw rod 100, and specifically, sleeved on an end of the screw rod 100 away from a driving mechanism. Generally, one section of mounting shaft mated with the inner hole of the one-way bearing 1 is disposed at the end of the screw rod 100. A mounting hole for receiving the one-way bearing 1 is disposed on the mounting seat 01, the one-way bearing 1 is rotatably fitted into the mounting hole along a circumferential direction, and an adjusting mechanism for adjusting a circumferential locking force of the mounting hole for the one-way bearing 1 is disposed on the mounting seat 01, so as to adjust a size of a friction force between an outer wall of the one-way bearing 1 and an inner wall of the mounting hole.

Figure 5:
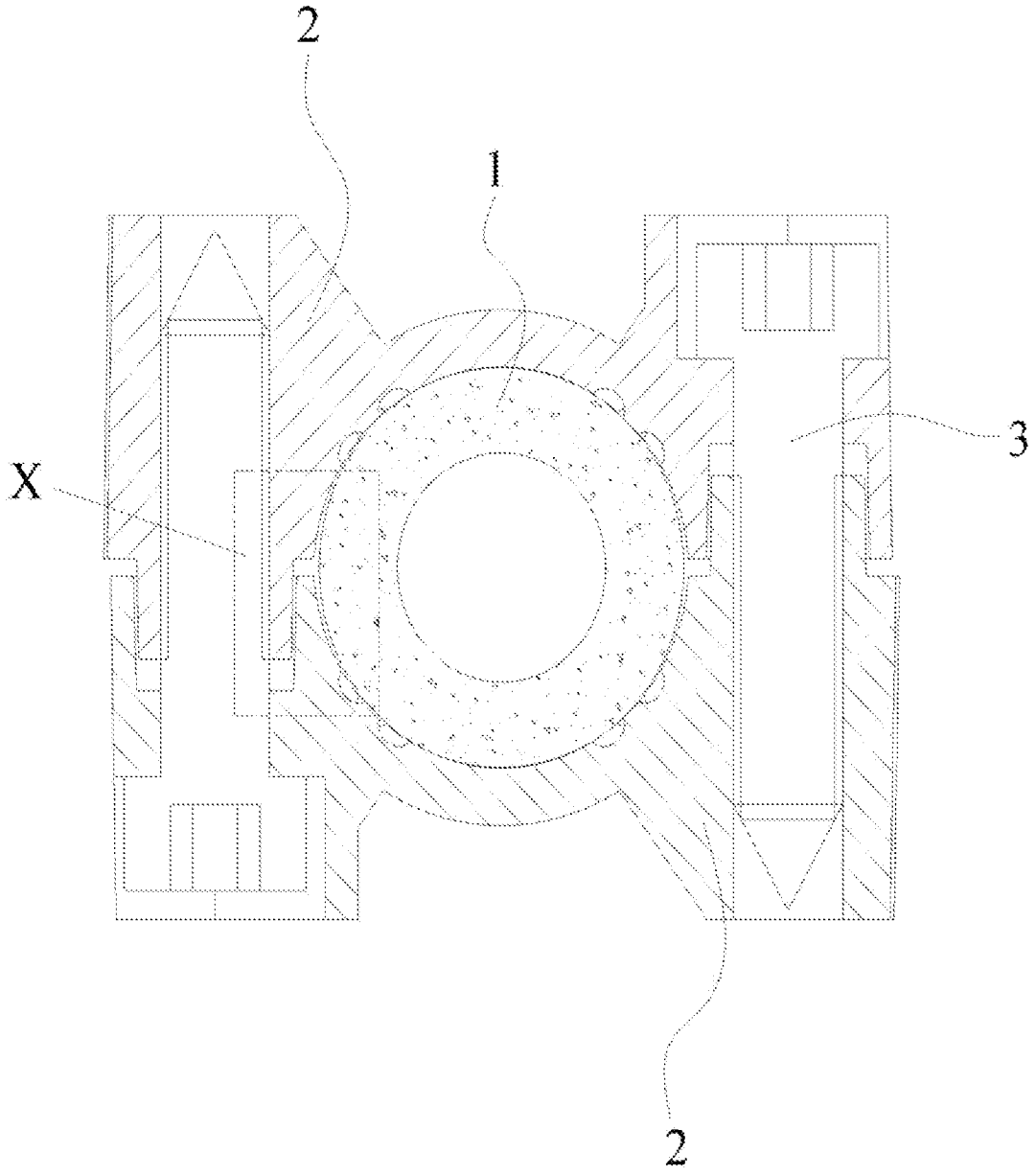
FIG. 5 is a horizontal sectional view of a screw rod self-locking device according to the present invention.
Figure 6:
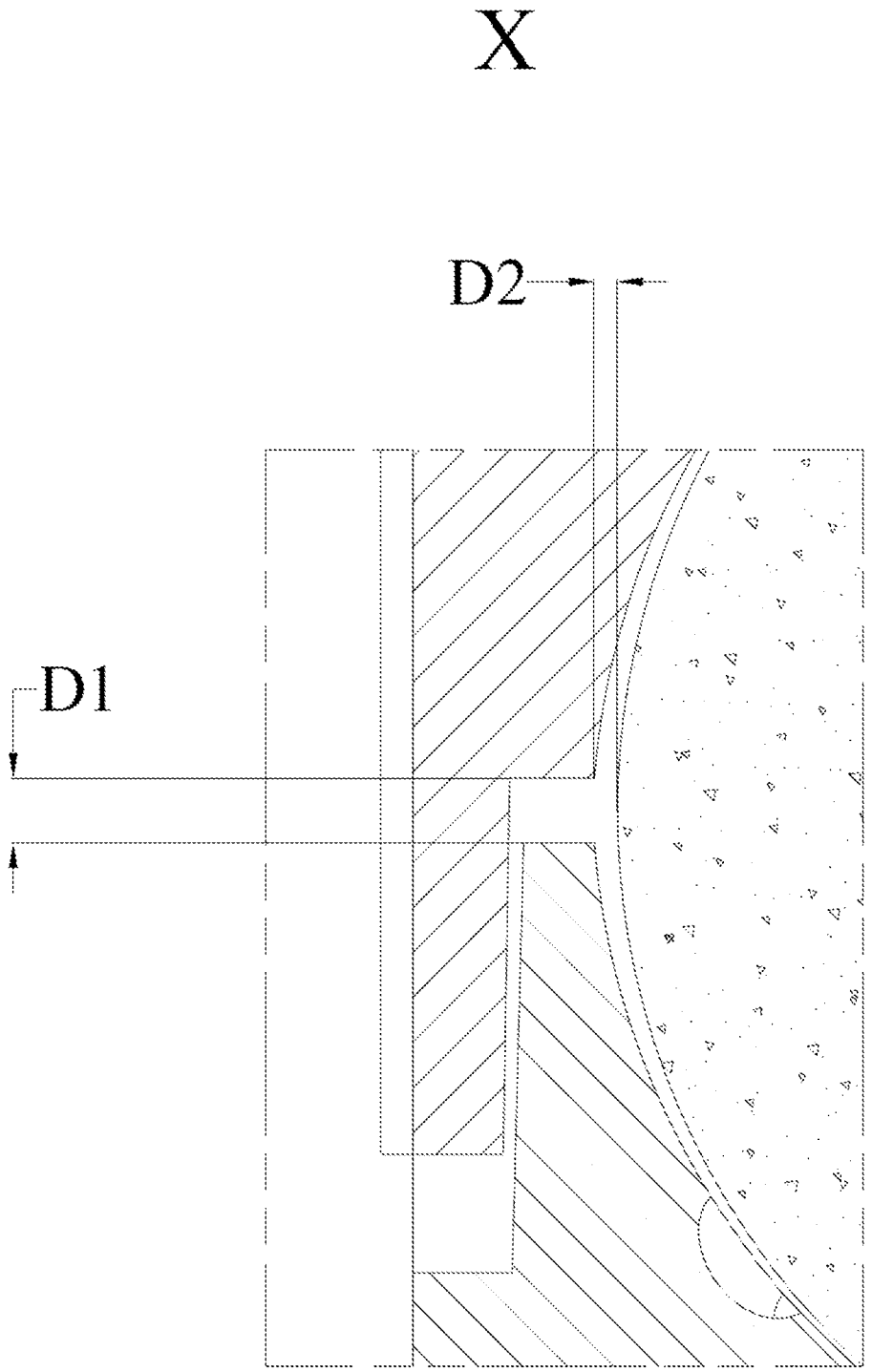
FIG. 6 is an enlarged structural diagram of the position X in FIG. 5.

In this embodiment, as shown in FIGS. 5 and 6, the mounting seat 01 comprises two split-type mounting blocks 2, an arc-shaped fitting groove 2.1 is disposed on each mounting block 2, and the two mounting blocks 2 are connected together through bolts 3 along opposite directions such that the two arc-shaped fitting grooves 2.1 are combined to form a mounting hole; when the one-way bearing 1 is fitted into the mounting hole, a first adjustment gap D1 is disposed between mating end faces of the two mounting blocks 2 and a size of the first adjustment gap D1 may be adjusted by rotating the bolts 3 to realize adjustment to the friction force between the outer wall of the one-way bearing 1 and the inner wall of the mounting hole. In this structure, the mounting seat 01 is divided into two mounting blocks, the one-way bearing 1 is locked up and limited between arc-shaped fitting grooves 2.1 of the two mounting blocks 2 and a locking force of the two mounting blocks 2 for the one-way bearing 1 may be adjusted by the bolts 3 to realize adjustment to a friction resistance between the one-way bearing 1 and the inner wall of the mounting hole. In this structure, when the screw rod 100 rotates forward, an outer ring of the one-way bearing 1 and the inner wall of the mounting hole are relatively stationary with only the screw rod 100 rotating in the inner hole of the one-way bearing 1; when the screw rod rotates backward, the screw rod 100 cannot rotate in the inner hole of the one-way bearing 1 due to the characteristic of one-way rotation of the one-way bearing 1, and at this time, the rotating screw rod 100 drives the one-way bearing 1 to rotate in the mounting hole simultaneously. Correspondingly, in a backward rotation process, a driving force of a driving mechanism needs to firstly overcome the friction resistance between the outer wall of the one-way bearing 1 and the inner wall of the mounting hole and then drive the one-way bearing 1 and the screw rod 100 to rotate synchronously. Due to uncertainty of the friction resistance between the outer wall of the one-way bearing 1 and the inner wall of the mounting hole, it is also a challenge for a driving power of the driving mechanism. After the self-locking device of the present invention is adopted, the reverse driving friction force of each product may be adjusted according to requirements of customers before leaving factory, so as to ensure consistency of product performances. That is, the friction resistances to be overcome during backward rotation are kept consistent and the requirements for the driving forces of the driving mechanisms are also consistent.

In another embodiment, the adjusting mechanism for adjusting the circumferential locking force of the mounting hole for the one-way bearing 1 may also be a limiting sleeve ring (not shown) deformable radially in the mounting hole of the mounting seat 01, and the one-way bearing 1 is slidably fitted into an inner hole of the limiting sleeve ring. Further, a driving element (not shown) for driving the limiting sleeve ring to deform radially toward a center of circle is disposed at a sidewall of the mounting seat 01. In this structure, when the screw rod 100 rotates backward, the friction force to be overcome is essentially a friction force between the one-way bearing 1 and an inner wall of the limiting sleeve ring, which may be adjusted by operating the corresponding driving element.

In this embodiment, in order to further improve the accurate adjustment to the friction force between the outer sidewall of the one-way bearing 1 and the inner sidewall of the mounting hole, when the one-way bearing 1 is fitted into the mounting hole, a second adjustment gap D2 is disposed between two widthwise sides of the arc-shaped fitting grooves 2.1 and the outer sidewall of the one-way bearing 1 as shown in FIG. 6. In this case, when the gap between two mounting blocks 2 is adjusted by tightening the bolts 3, the two sides of the arc-shaped fitting groove 2.1 of each mounting block 2 will be attached closer to the sidewall of the one-way bearing 1 to increase a contact area between the inner sidewall of the mounting hole and the outer sidewall of the one-way bearing 1, thus increasing the friction force between the outer wall of the one-way bearing 1 and the inner wall of the mounting hole. When it is required to reduce the friction resistance between the outer wall of the one-way bearing 1 and the inner wall of the mounting hole, the bolts 3 may be fine-tuned reversely.

Furthermore, in this structure, in order to ensure the one-way bearing 1 can be limited axially in the mounting hole, a limiting baffle plate 2.5 is disposed at both axial ends of the arc-shaped fitting groove 2.1 of the mounting block 2 respectively, such that the one-way bearing 1 is located between the two limiting baffle plates 2.5 after being mounted. Furthermore, in this structure, both ends of the mounting block 2 will bend to deform along a middle portion when the bolts 3 are tightened. In order to facilitate bending deformation of the mounting block 2, a notch 2.5.1 is disposed at a position of the limiting baffle plate 2.5 corresponding to a middle portion of the arc-shaped fitting groove 2.1, and the notch 2.5.1 extends radially to the bottom of the arc-shaped fitting groove 2.1.

Figure 3:
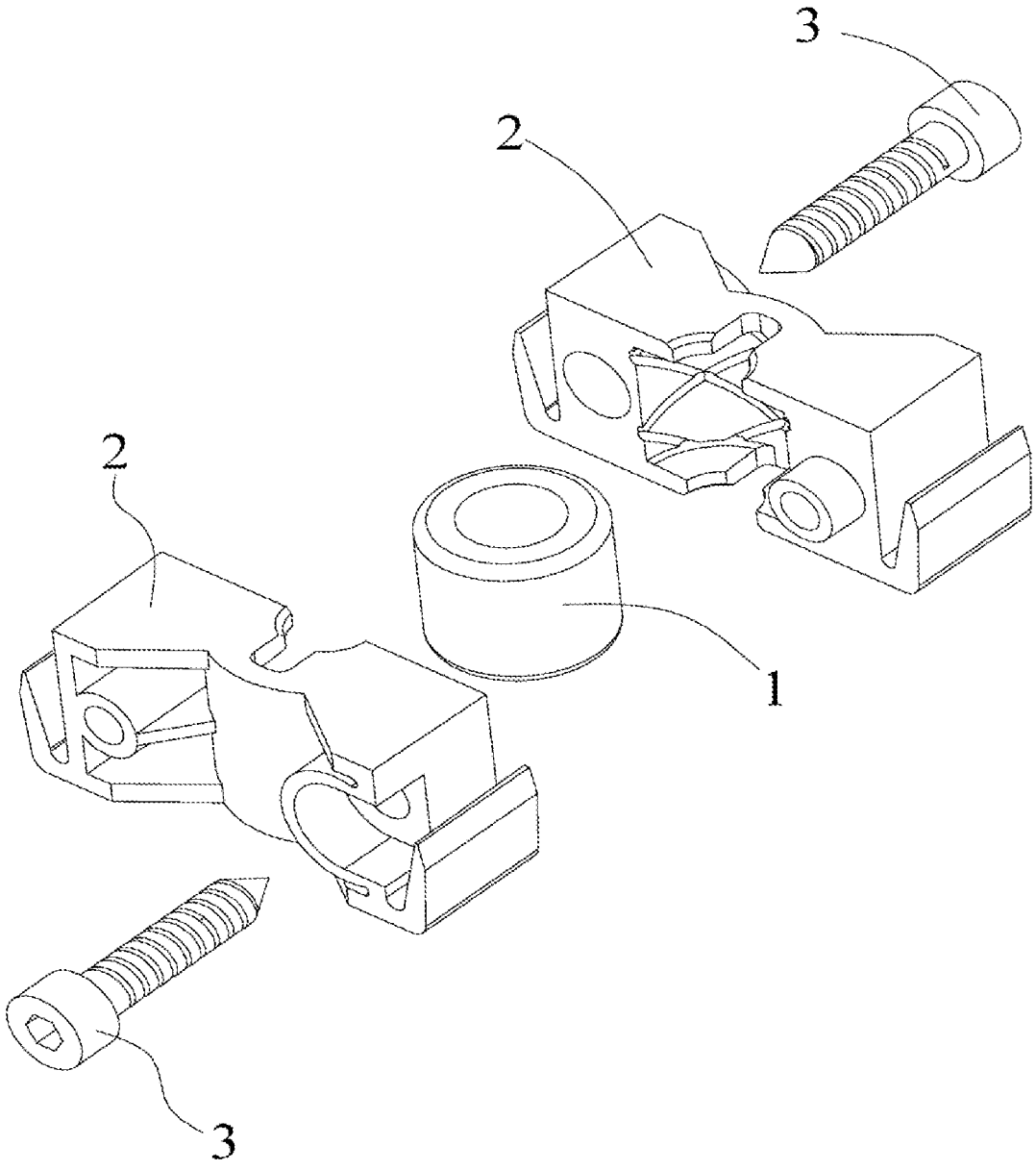
FIG. 3 is an exploded view of a screw rod self-locking device according to the present invention.
Figure 4:
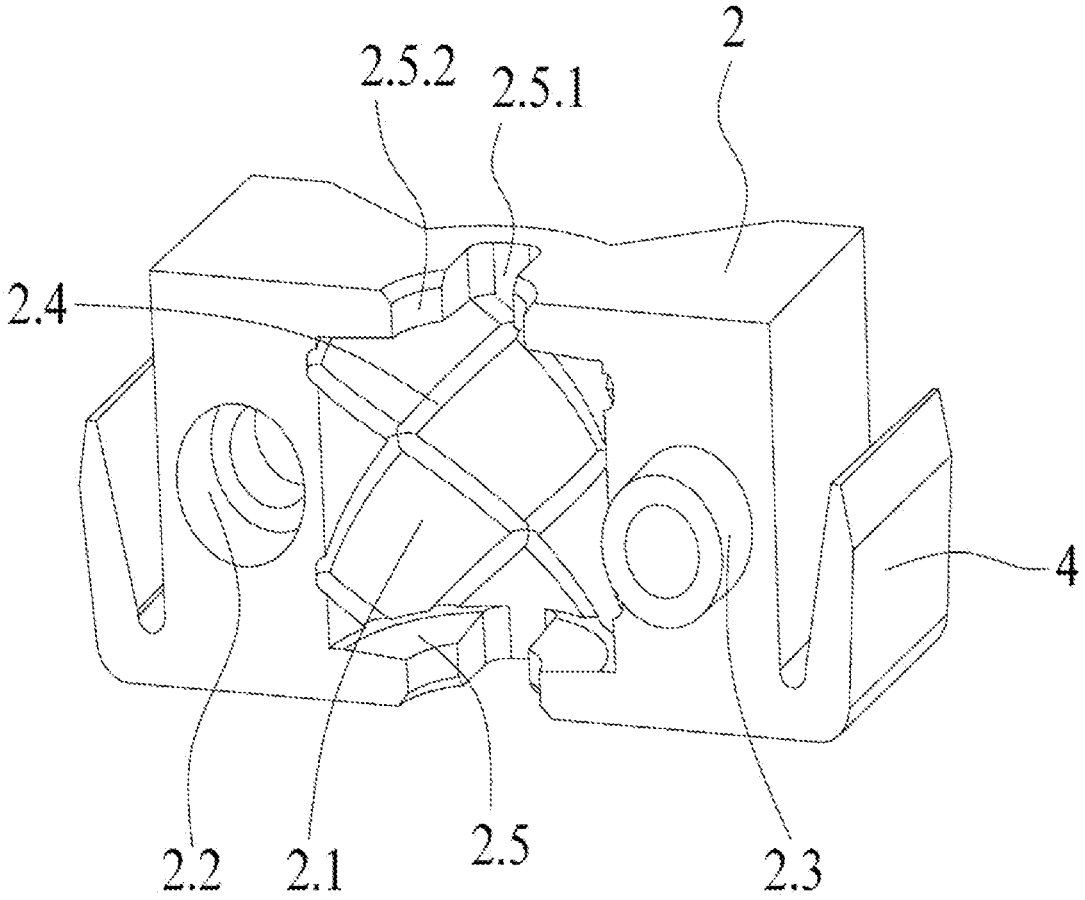
FIG. 4 is a structural schematic diagram of a mounting block according to the present invention.

As shown in FIGS. 3, 4, and 5, a locating insertion hole 2.2 and a locating insertion column 2.3 are respectively disposed at two ends of the two mounting blocks 2 close to the one-way bearing 1, and the locating insertion hole 2.2 and the locating insertion column 2.3 on the two mounting blocks 2 are staggered in position. With the improved structure, guiding and limitation effect can be achieved when the two mounting blocks 2 are mounted along opposite directions. Specifically, the two mounting blocks 2 are defined as a first mounting block and a second mounting block respectively. As shown in FIG. 4, the locating insertion hole 2.2 is opened at the left side of the mounting end face of the first mounting block and the locating insertion column 2.3 is convexly disposed at the right side. Correspondingly, the locating insertion column 2.3 mated with the locating insertion hole 2.2 is disposed at the left side of the second mounting block and the locating insertion hole 2.2 mated with the locating insertion column 2.3 is disposed at the right side. With the mutually-staggered limiting structure, the locating stability at the time of the fitting mounting can be further improved. In this structure, in order to facilitate processing and locating, the bolts are disposed coaxially with the locating insertion column 2.3 and the locating insertion hole 2.2, a round through hole is disposed at a position corresponding to the locating insertion hole 2.2 on each mounting block 2, and a threaded hole is disposed at a position corresponding to the locating insertion column 2.3 on each mounting block 2. When the two mounting blocks 2 are mounted along opposite directions, the two mounting blocks 2 are fixed by inserting two bolts 3 from one mounting block 2 into another mounting block 2. Such centrally-symmetrical structure fixed by bolts 3 enables the gap adjustment between the two mounting blocks 2 to be more stable and uniform, that is, the friction force between the outer wall of the one-way bearing 1 and the inner wall of the mounting hole can be adjusted more accurately.

Furthermore, in order to ensure stable performance and long service life of the one-way bearing 1, a lubrication groove for filling lubricant is disposed at the inner sidewall of the mounting hole and/or the outer sidewall of the one-way bearing 1, or disposed at the inner sidewall of the mounting hole and the outer sidewall of the one-way bearing 1 at the same time. During bearing mounting, a given amount of lubricant may be filled in the lubrication groove to ensure smooth rotation of the one-way bearing 1 in the mounting hole, thus reducing generation of frictional heat and improving the service life. In this embodiment, the lubrication groove comprises a plurality of helical grooves 2.4 disposed at the inner sidewall of the arc-shaped fitting grooves 2.1 and extending axially, and the plurality of helical grooves 2.4 are distributed in the form of grid. In this structure, the lubrication groove is disposed into a plurality of helical grooves distributed in the form of grid, such that the entire channel between the outer wall of the one-way bearing 1 and the inner wall of the mounting hole can be uniformly filled with lubricant. Thus, the lubrication effect during the rotation of the one-way bearing 1 in the mounting hole can be effectively improved, reducing the frictional heat and prolonging the service life. Further, no abnormal sound is generated.

Furthermore, as shown in FIGS. 1, 2 and 4, an arc-shaped locating groove 2.5.2 is further disposed at a position of the limiting baffle plate 2.5 close to the center of the one-way bearing 1 to form a locating plate mated with a locating recessed groove 100.1 pre-disposed on the screw rod 100. In this case, when the screw rod 100 and the self-locking device can are mounted, the one-way bearing 1 is firstly sleeved on an end of the screw rod 100, then the screw rod 100 with the one-way bearing 1 is mounted into the arc-shaped fitting groove 2.1 of one mounting block 2 and the locating recessed grooves 100.1 pre-disposed on the screw rod 100 are fitted into the corresponding arc-shaped locating grooves 2.5.2 of the two limiting baffle plate 2.5 on the mounting block 2 respectively; next, the other mounting block 2 and the mounting block 2 holding the screw rod 100 are press-mounted along opposite directions and then tightened by the bolts 3. After the two mounting blocks 2 are mounted to be in place, the one-way bearing 1 is accommodated in the mounting hole between the two mounting blocks 2. In cooperation with the corresponding locating plates, the two locating recessed grooves 100.1 pre-disposed on the screw rod 100 achieve axial locating of the screw rod 100. That is, in this structure, the self-locking device and the screw rod 100 can be axially fixed only by fitting the two mounting blocks 2 without using other fasteners. Therefore, the structure is simple and the mounting is convenient. In the prior art, because the bearing seat is of integral structure, during mounting, the one-way bearing 1 is firstly mounted into the mounting hole of the bearing seat, and then the screw rod 100 is inserted into the one-way bearing 1. In such structure, one axial locating piece is to be further disposed at the outer end of the screw rod 100 to prevent axial separation of the bearing seat from the screw rod 100. Compared with the prior art, the structure of this embodiment has fewer parts and is easier to mount, and more stable axial limitation can be achieved for the screw rod 100.

Figure 7:
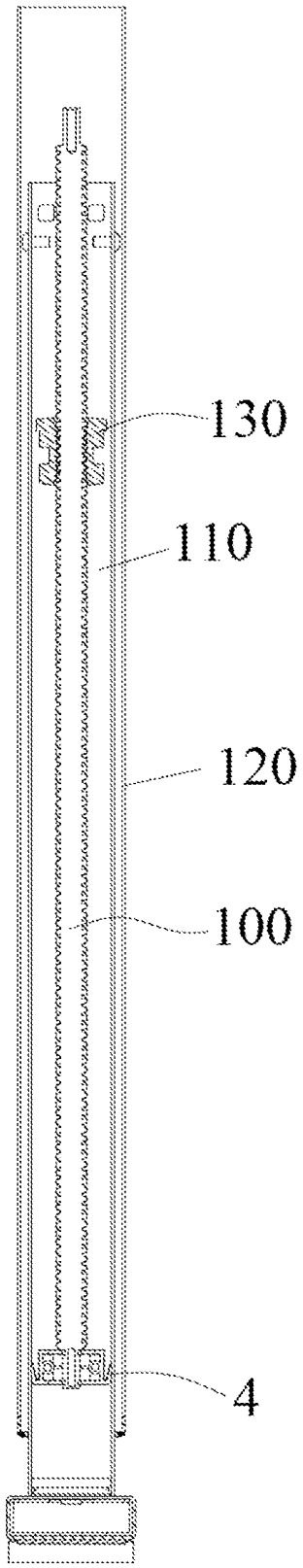
FIG. 7 is a sectional diagram of a height-adjustable leg according to the present invention.

As shown in FIG. 7, the present invention further provides a height-adjustable leg, comprising an inner tube 110 and an outer tube 120. The outer tube 120 is slidably sleeved on the inner tube 110, the screw rod 100 is inserted through the inner tube 110, a screw rod sliding block 130 is sleeved on the screw rod 100, the screw rod sliding block 130 is fixedly connected with the inner tube 110, and an end of the screw rod 100 is connected with a driving mechanism. In this structure, when the driving mechanism drives the screw rod 100 to rotate forward or backward, the screw rod sliding block 130 is moved up and down under the thread guiding action of the screw rod 100, thereby driving the inner tube 100 to slide up and down in the outer tube 120, and realizing height adjustment to the leg. The height-adjustable leg structure further comprises the above screw rod self-locking device which is connected to an end of the screw rod 100 away from the driving mechanism. In order to ensure stability of the self-locking device in the inner tube 110, an elastic limiting portion for limiting the self-locking device to the sidewall of the inner tube 110 is disposed at the outer sidewall of the self-locking device. In this structure, under the action of the reverse self-locking resistance of the self-locking device, the screw rod 100 will not easily rotate backward when the height-adjustable leg is in an extended state, that is, the height-adjustable leg will not lower its height under the action of its gravity alone.

Specifically, the elastic limiting portion comprises at least two elastic limiting plates 4 symmetrically disposed on the sidewalls of the mounting block 2. The elastic limiting plate 4 is abutted against the sidewall of the inner tube 110 in a limited manner. One end of the elastic limiting plate 4 extends upward along an axial direction of the inner tube 110. In another embodiment, the elastic limiting plate 4 may also be a structure bending to extend downward at the sidewall of the mounting block 2. The two different structures determine the insertion direction in which the screw rod 100 in the self-locking device is inserted into the inner tube 110.

Furthermore, the elastic limiting plate 4 in the above structure may elastically deform along a radial direction of the inner tube 110. In an initial state, a distance between the elastic limiting plates 4 at both sides of the mounting block 2 is slightly greater than a width of an inner diameter of the inner tube 110, and the outer sidewall of the two elastic limiting plate 4 is disposed to be inclined. Specifically, a width of an upper opening side of the elastic limiting plate 4 is larger than a lower connection as shown in FIG. 4. In this case, during mounting, the screw rod 100 with the self-locking device may be directly inserted into the inner tube 110 from top down. In another structure, if the elastic limiting plate 4 is bent downward at the sidewall of the mounting block 2 and a width of a lower opening portion is larger than an upper connection, the screw rod 100 with the self-locking device needs to be inserted into the inner tube 110 from bottom up for locating.

During the above mounting process, under the action of an axial squeezing force, the elastic limiting plates 4 at both sides of the mounting block 2 deform inwardly. When the screw rod 100 slides to a predetermined height in the inner tube 110, the axial squeezing force will be released. At this time, under the action of the reverse elastic force of the elastic limiting plates 4, a friction force between the elastic limiting plate 4 and the inner tube 110 will be generated to ensure the entire self-locking device is stably limited in the inner tube 110. Furthermore, the inner tube 110 and the outer tube 120 in this structure are both square tubes, such that the self-locking device will not rotate circumferentially after being limited, thus ensuring stable rotation of the screw rod 100 and no offset of the lower end of the screw rod 100.

Figure 8:
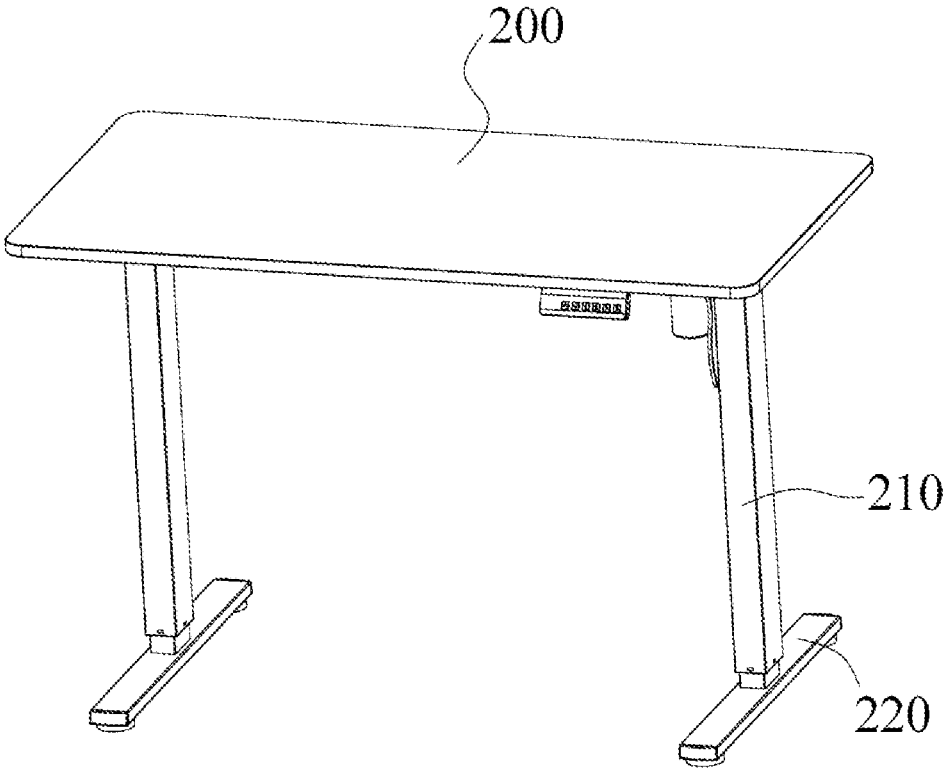
FIG. 8 is a structural schematic diagram of a height-adjustable desk according to the present invention.

As shown in FIG. 8, the present invention further provides a height-adjustable desk comprising a rectangular load-bearing board 200. Two desk legs 210 are disposed at a lower end of the load-bearing board 200, and specifically disposed at both lengthwise ends of the load-bearing board 200 symmetrically, and at least one of the two desk legs 210 is the above height-adjustable leg. Further, in order to ensure entire stability of the desk, a transversely-disposed support rod 220 is connected at the lower ends of the desk leg 210 respectively.

In this height-adjustable desk structure, one desk leg 210 may be a height-adjustable leg and the other desk leg 210 is not limited in height adjustment; or, both of the desk legs 210 are the above height-adjustable legs.

The above descriptions are made to the preferred embodiments of the present invention and shall not be understood as limiting of the claims. The present invention is not limited to the above embodiments and thus allows changes to the specific structure. Various changes made within the scope of protection of the independent claims of the present invention shall all fall within the scope of protection of the present invention.

What is claimed is:

1. A screw rod self-locking device, comprising a one-way bearing and a mounting seat, wherein an inner hole of the one-way bearing is sleeved at an end of a screw rod;

a mounting hole for receiving the one-way bearing is disposed on the mounting seat;

the one-way bearing is rotatably fitted into the mounting hole along a circumferential direction;

an adjusting mechanism for adjusting a circumferential locking force of the mounting hole for the one-way bearing is disposed on the mounting seat to adjust a size of a friction force between an outer wall of the one-way bearing and an inner wall of the mounting hole;

the mounting seat comprises two split-type mounting blocks;

an arc-shaped fitting groove is disposed on each split-type mounting block of the two split-type mounting blocks, and the two split-type mounting blocks are connected together through bolts along opposite directions, wherein two arc-shaped fitting grooves are combined to form the mounting hole; and when the one-way bearing is fitted into the mounting hole, a first adjustment gap is disposed between mating end faces of the two split-type mounting blocks, and a size of the first adjustment gap is adjusted by rotating the bolts to realize adjustment to the friction force between the outer wall of the one-way bearing and the inner wall of the mounting hole.

2. The screw rod self-locking device of claim 1, wherein a locating insertion hole and a locating insertion column are respectively disposed at two ends of the two split-type mounting blocks, wherein the two ends of the two split-type mounting blocks are adjacent to the one-way bearing; and the locating insertion hole and the locating insertion column on the two split-type mounting blocks are staggered in position.

3. The screw rod self-locking device of claim 1, wherein a lubrication groove for filling lubricant is disposed at the inner wall of the mounting hole.

4. The screw rod self-locking device of claim 3, wherein the lubrication groove comprises a plurality of helical grooves disposed at an inner sidewall of the two arc-shaped fitting grooves and extending axially, and the plurality of helical grooves are distributed in a form of grid.

5. The screw rod self-locking device of claim 1, wherein when the one-way bearing is fitted into the mounting hole, a second adjustment gap is disposed between two widthwise sides of the two arc-shaped fitting grooves and the outer wall of the one-way bearing.

6. The screw rod self-locking device of claim 5, wherein a limiting baffle plate is disposed at both axial ends of the arc-shaped fitting groove of the each split-type mounting block respectively;

a notch is disposed at a position of the limiting baffle plate corresponding to a middle portion of the arc-shaped fitting groove; and the notch extends radially to a bottom of the arc-shaped fitting groove.

7. The screw rod self-locking device of claim 6, wherein an arc-shaped locating groove is further disposed at a position of the limiting baffle plate adjacent to a center of the one-way bearing to form a locating plate mated with a locating recessed groove pre-disposed on the screw rod.

8. A height-adjustable leg, comprising an inner tube, an outer tube, and a screw rod self-locking device, wherein the screw rod self-locking device comprises a one-way bearing and a mounting seat;

an inner hole of the one-way bearing is sleeved at an end of a screw rod;

a mounting hole for receiving the one-way bearing is disposed on the mounting seat;

the one-way bearing is rotatably fitted into the mounting hole along a circumferential direction;

an adjusting mechanism for adjusting a circumferential locking force of the mounting hole for the one-way bearing is disposed on the mounting seat to adjust a size of a friction force between an outer wall of the one-way bearing and an inner wall of the mounting hole;

the outer tube is slidably sleeved on the inner tube;

the screw rod is inserted through the inner tube;

a screw rod sliding block is sleeved on the screw rod;

the screw rod sliding block is fixedly connected to the inner tube;

a first end of the screw rod is connected to a driving mechanism;

the screw rod self-locking device is connected to a second end of the screw rod, wherein the second end of the screw rod is away from the driving mechanism; and an elastic limiting portion for limiting the screw rod self-locking device to a sidewall of the inner tube is disposed at an outer sidewall of the screw rod self-locking device.

9. The height-adjustable leg of claim 8, wherein the elastic limiting portion comprises at least two elastic limiting plates symmetrically disposed on sidewalls of the each split-type mounting block;

the at least two elastic limiting plates are abutted against the sidewall of the inner tube in a limited manner; and one end of the at least two elastic limiting plates extends along an axial direction of the inner tube and is configured to deform elastically along an radial direction of the inner tube.

10. A height-adjustable desk, comprising a load-bearing board, wherein two desk legs are disposed at a lower end of the load-bearing board, wherein two desk legs comprise at least one height-adjustable leg of claim 8.

11. The height-adjustable desk of claim 10, wherein the elastic limiting portion comprises at least two elastic limiting plates symmetrically disposed on sidewalls of the each split-type mounting block;

the at least two elastic limiting plates are abutted against the sidewall of the inner tube in a limited manner; and one end of the at least two elastic limiting plates extends along an axial direction of the inner tube and is configured to deform elastically along a radial direction of the inner tube.

12. The height-adjustable leg of claim 8, wherein the mounting seat comprises two split-type mounting blocks;

an arc-shaped fitting groove is disposed on each split-type mounting block of the t split-type mounting blocks, and the two split-type mounting blocks are connected together through bolts along opposite directions, wherein two arc-shaped fitting grooves are combined to form the mounting hole;

when the one-way bearing is fitted into the mounting hole, a first adjustment gap is disposed between mating end faces of the two split-type mounting blocks, and a size of the first adjustment gap is adjusted by rotating the bolts to realize adjustment to the friction force between the outer wall of the one-way bearing and the inner wall of the mounting hole.

13. The height-adjustable leg of claim 12, wherein a locating insertion hole and a locating insertion column are respectively disposed at two ends of the two split-type mounting blocks, wherein the two ends of the two split-type mounting blocks are adjacent to the one-way bearing; and the locating insertion hole and the locating insertion column on the two split-type mounting blocks are staggered in position.

14. The height-adjustable leg of claim 12, wherein when the one-way bearing is fitted into the mounting hole, a second adjustment gap is disposed between two widthwise sides of the two arc-shaped fitting grooves and the outer wall of the one-way bearing.

15. The height-adjustable leg of claim 14, wherein a limiting baffle plate is disposed at both axial ends of the arc-shaped fitting groove of the each split-type mounting block respectively;

a notch is disposed at a position of the limiting baffle plate corresponding to a middle portion of the arc-shaped fitting groove; and the notch extends radially to a bottom of the arc-shaped fitting groove.

16. The height-adjustable leg of claim 15, wherein an arc-shaped locating groove is further disposed at a position of the limiting baffle plate adjacent to a center of the one-way bearing to form a locating plate mated with a locating recessed groove pre-disposed on the screw rod.

17. The height-adjustable leg of claim 8, wherein a lubrication groove for filling lubricant is disposed at the inner wall of the mounting hole.

18. The height-adjustable leg of claim 17, wherein the lubrication groove comprises a plurality of helical grooves disposed at an inner sidewall of two arc-shaped fitting grooves and extending axially, and the plurality of helical grooves are distributed in a form of grid.

* * * * *